US008262289B2

(12) United States Patent
Fratti et al.

(10) Patent No.: US 8,262,289 B2
(45) Date of Patent: Sep. 11, 2012

(54) REVERSIBLE FASTENER FOR A RESEALABLE BAG-TYPE CONTAINER

(75) Inventors: Roger A. Fratti, Mohnton, PA (US); Cathy Lynn Hollien, Bridgewater, NJ (US)

(73) Assignee: Agere Systems Inc., Allentown, PA (US)

( * ) Notice: Subject to any disclaimer, the term of this patent is extended or adjusted under 35 U.S.C. 154(b) by 385 days.

(21) Appl. No.: 12/521,958

(22) PCT Filed: Jan. 31, 2007

(86) PCT No.: PCT/US2007/061394

§ 371 (c)(1), (2), (4) Date: Jul. 1, 2009

(87) PCT Pub. No.: WO2008/094264

PCT Pub. Date: Aug. 7, 2008

(65) Prior Publication Data

US 2010/0021091 A1 Jan. 28, 2010

(51) Int. Cl.
*B65D 33/16* (2006.01)
*B65D 33/00* (2006.01)

(52) U.S. Cl. ..... 383/63; 383/105

(58) Field of Classification Search ..... 383/63, 383/65, 33, 35, 105; 24/584.1, DIG. 39, 24/399, 400

See application file for complete search history.

(56) References Cited

U.S. PATENT DOCUMENTS 4,046,408 A 9/1977 Ausnit
4,079,767 A 3/1978 Howard
4,578,813 A 3/1986 Ausnit
4,738,882 A 4/1988 Rayford et al.
4,939,819 A * 7/1990 Moyer ..... 24/16 R
5,097,949 A 3/1992 Heldwein
5,180,615 A 1/1993 Havens
6,164,826 A 12/2000 Petkovsek
6,519,917 B2 * 2/2003 Forman ..... 53/412
6,533,456 B1 3/2003 Buchman
6,572,267 B1 * 6/2003 Forman ..... 383/61.2
6,783,276 B2 8/2004 Machacek et al.
6,899,460 B2 * 5/2005 Turvey et al. ..... 383/33
7,029,178 B2 4/2006 Gzybowski
7,137,736 B2 11/2006 Pawloski et al.
7,364,361 B2 * 4/2008 Turvey et al. ..... 383/33

OTHER PUBLICATIONS

Search Report for PCT/US2007/061394 dated Nov. 14, 2007.

* cited by examiner

*Primary Examiner* — Jes F Pascua
(74) *Attorney, Agent, or Firm* — Ryan, Mason & Lewis, LLP

(57) ABSTRACT

A reversible fastener is provided for a resealable bag-type container (100) having first and second opposing wall panels (102,104), each of the first and second opposing wall panels having an interior face and an exterior face. The fastener includes first and second closure mechanisms. The first closure mechanism (114) includes first and second complementary interlockable components (116,118) disposed on the interior face of each of the first and second opposing wall panels proximate a top periphery (112) of the first and second opposing wall panels. The second closure mechanism (120) includes first and second complementary interlockable components (122,124) disposed on the exterior face of each of the first and second opposing wall panels proximate a top periphery of the first and second opposing wall panels.

26 Claims, 5 Drawing Sheets

REVERSIBLE FASTENER FOR A RESEALABLE BAG-TYPE CONTAINER

FIELD OF THE INVENTION

The present invention relates generally to bag-type containers, and more particularly to closure mechanisms for resealable bag-type containers.

BACKGROUND OF THE INVENTION

Resealable bag-type containers (e.g., Ziploc® bags, a registered trademark of S.C. Johnson & Son, Inc.) are often formed of a laminated plastic film material, the various plies of the laminate having desired barrier and other properties to protect the contents stored therein. Typically, bag-type containers are provided with mouths or openings along a top edge of the containers. The mouths or openings are often defined by opposed wall panels of the containers which are adapted to be coupled together along the top edge in a closed position, or uncoupled in an open position.

To provide such a resealing function, the opposed wall panels of a given bag-type container are typically provided with a fastener including a single pair of complementary interlockable components. The fastener of the container is generally designed to enable a user to open the container by gripping the wall panels of the container with thumb and forefinger of each hand along the top edge and simply pulling the wall panels apart. This results in the separation of the interlockable components of the fastener, thereby providing access to the contents of the container through the open mouth. The bag-type container is then resealed by simply pinching the complementary pair of interlockable components together. Some other bag-type containers employ a zipper-type pull arrangement to seal the container.

Often, users of resealable bag-type containers will reuse a container, such as by turning the container inside-out. However, once the container is turned inside-out it is unable to be resealed, since the complementary interlockable components forming the fastener are now facing away from one another outside of the container.

Accordingly, there exists a need for a fastener for use in conjunction with a resealable bag-type container which does not suffer from one or more of the above-noted problems exhibited by conventional fasteners for bag-type containers.

SUMMARY OF THE INVENTION

The present invention, in illustrative embodiments thereof, meets the above-noted need by providing a reversible fastener for use in conjunction with a resealable bag-type container which overcomes certain characteristic limitations associated with conventional fasteners. The illustrative reversible fastener is adapted to enable the bag-type container to be resealed both when used in a standard manner and when turned inside out. Advantageously, in accordance with other illustrative aspects of the invention, a resealable bag-type container may include multiple reversible fasteners along a periphery of at least two sides of the container (e.g., top edge and one or more side edges) to thereby facilitate the insertion of large, bulky items into the container.

In accordance with one aspect of the invention, a reversible fastener is provided for a resealable bag-type container having first and second opposing wall panels, each of the first and second opposing wall panels having an interior face and an exterior face. The fastener includes first and second closure mechanisms. The first closure mechanism includes first and second complementary interlockable components disposed on the interior face of each of the first and second opposing wall panels proximate a top periphery of the first and second opposing wall panels. The second closure mechanism includes first and second complementary interlockable components disposed on the exterior face of each of the first and second opposing wall panels proximate a top periphery of the first and second opposing wall panels. Methods for forming a reversible fastener for use with a resealable bag-type container are also provided.

In accordance with another aspect of the invention, a resealable bag-type container includes first and second opposing wall panels, each of the first and second opposing wall panels having an interior face and an exterior face. At least a portion of the first and second opposing wall panels are joined together along a periphery thereof. The container further includes at least one reversible fastener including at least first and second closure mechanisms disposed along a remaining portion of the periphery of the first and second opposing wall panels. Each of the first and second closure mechanisms includes first and second complementary interlockable components. The first closure mechanism is disposed on the interior face of each of the first and second opposing wall panels, and the second closure mechanism is disposed on the exterior face of each of the first and second opposing wall panels. Methods for forming a reversible bag-type container are also provided.

These and other features, advantages and objects of the present invention will become apparent from the following detailed description of illustrative embodiments thereof, which is to be read in connection with the accompanying drawings.

DETAILED DESCRIPTION OF THE INVENTION

The present invention will be described herein in the context of illustrative embodiments of a reversible, resealable bag. It should be understood, however, that the present invention is not limited to the particular bag arrangements shown. Rather, the present invention provides techniques for advantageously overcoming certain characteristic limitations of conventional resealable bags. Specifically, techniques are provided for forming a reversible closure mechanism for bag-type containers. The reversible closure mechanism formed according to illustrative embodiments of the invention can be used in conjunction with a variety of containers that include mouths defined by opposed panel members. For example, the reversible closure mechanism of the present invention can be readily incorporated into the structure of conventional Ziploc® plastic bags and the like.

Figure 1:
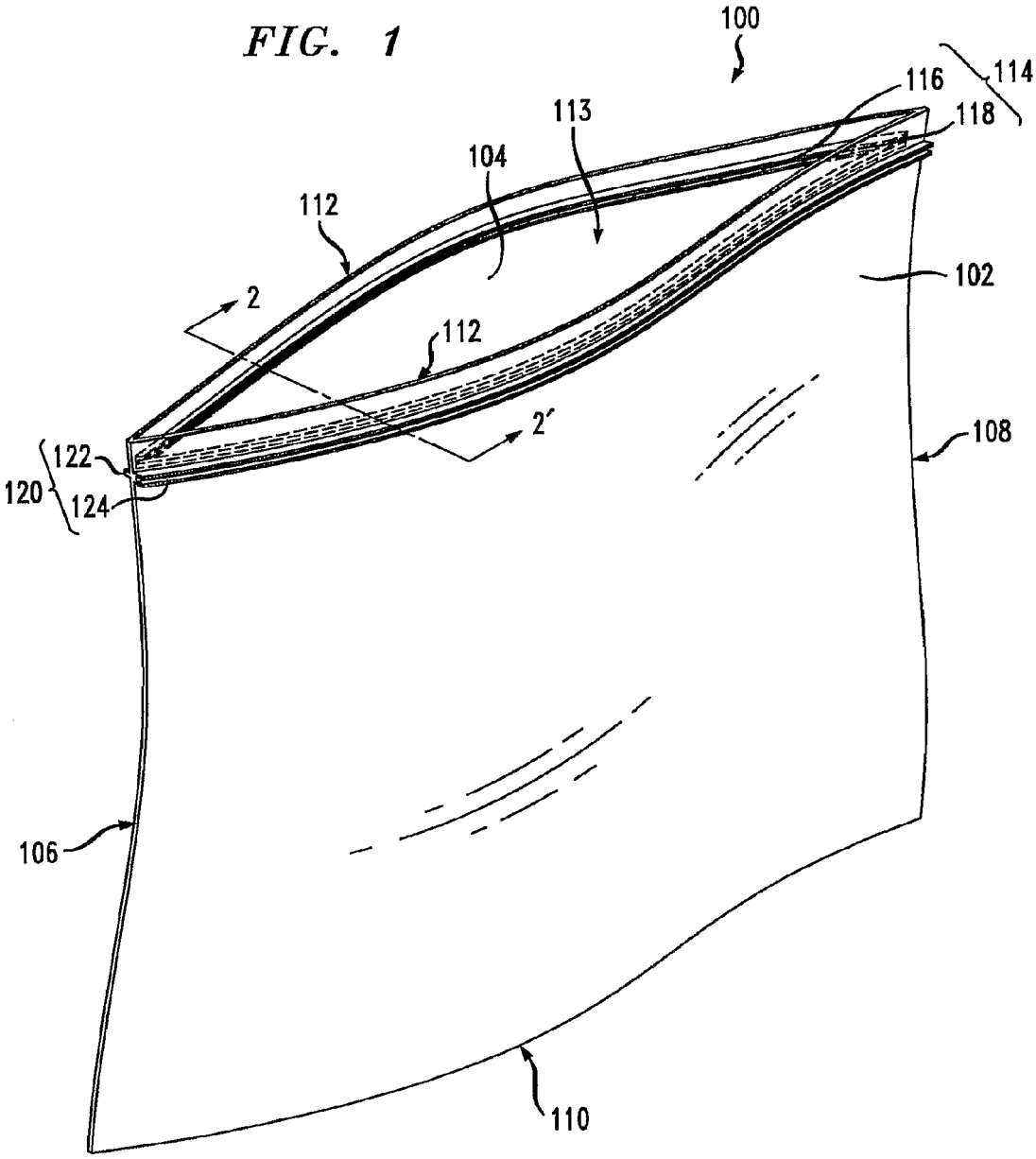
FIG. 1 is a top perspective view illustrating an exemplary resealable bag-type container including a reversible fastener, formed in accordance with an embodiment of the present invention.
Figure 2:
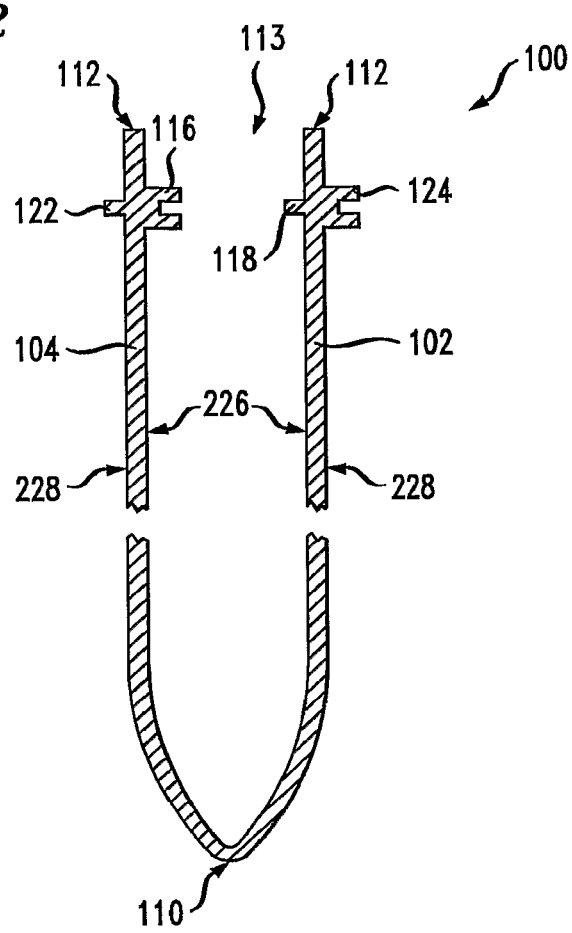
FIG. 2 is a cross-sectional view of the exemplary bag-type container shown in FIG. 1, taken along line 2-2', in accordance with an embodiment of the invention.

FIGS. 1 and 2 are views of an exemplary bag-type container 100 including a reversible fastener, formed in accordance with an embodiment of the present invention. FIG. 1 is a perspective view of bag-type container 100, and FIG. 2 is a cross-sectional view of at least a portion of the bag-type container taken along line 2-2' shown in FIG. 1. Bag-type container 100 includes opposing wall panels 102 and 104, which preferably face toward each other and extend between side edges 106 and 108, a bottom edge 110 and a top edge 112. Although shown in the figure as being substantially rectangular in shape, the invention is not limited to any particular size and/or shape of the bag-type container 100.

The wall panels 102 and 104 are preferably joined together or integral along at least a portion of one or more of the bottom edge 110 and side edges 106 and 108. For example, wall panels 102 and 104 may be joined along side edges 106 and 108 by heat sealing, or an alternative joining process, while the wall panels may be integral along bottom edge 110 by folding down a center line. Alternatively, wall panels 102 and 104 may be integral along at least one side edge, 106 or 108, and may be joined, for example, by heat sealing or an alternative joining process, along bottom edge 110. In either case, wall panels 102 and 104, when joined together, preferably define an interior space adapted for storing one or more items in a conventional manner, with the top edge 112 of bag-type container 100 providing an opening or mouth 113 for accessing the interior space of the container.

The access opening 113 of bag-type container 100 is adapted to be closed and opened by a reversible fastener comprising at least first and second separable and resealable closure mechanisms 114 and 120, respectively. The reversible fastener preferably runs along substantially the entire length of the top edge 112 of the container. First closure mechanism 114 is preferably provided along at least a portion of the top edge 112 of the container. First closure mechanism 114 preferably includes first and second complementary interlockable components 116 and 118, respectively, which can be coupled together or interlocked. First complementary interlockable component 116 is disposed on an interior face of wall panel 104 proximate the top edge 112. Likewise, second complementary interlockable component 118 is disposed on an interior face of opposing wall panel 102 proximate the top edge 112. First and second complementary interlockable components 116, 118 may be formed integrally with their respective wall panels, 104, 102, such as, for example, by extrusion. Alternatively, first and second complementary interlockable components 116, 118 may be affixed to their respective wall panels, 104, 102, for example by fusing, adhesive, or some other attachment means. It is to be understood, however, that the invention is not limited to the method of forming the first and second complementary interlockable components 116, 118 on wall panels 104, 102.

First and second complementary interlockable components 116 and 118 are preferably particularly well-adapted for mutually facilitating alignment and interlocking closure engagement with one another by closing pressure applied from outside of wall panels 102 and 104 toward first closure mechanism 114 in order to seal bag-type container 100. Bag-type container 100 is relatively easily opened from the top edge 112 by separating manipulation of first and second complementary interlockable components 116 and 118 of first closure mechanism 114.

Second closure mechanism 120 of the reversible fastener, like first closure mechanism 114, preferably includes first and second complementary interlockable components 122 and 124, respectively. First complementary interlockable component 122 is disposed on an exterior face of wall panel 104. Likewise, second complementary interlockable component 124 is disposed on an exterior face of wall panel 102. First and second complementary interlockable components 122, 124 may be formed integrally with their respective wall panels, 104, 102, such as, for example, by extrusion. Alternatively, first and second complementary interlockable components 122, 124 may be affixed to their respective wall panels, 104, 102, for example by fusing, adhesive, or some other attachment means. The invention, however, is not limited to the method of forming the first and second complementary interlockable components 122, 124 on wall panels 104, 102. Moreover, first and second closure mechanisms 114 and 120, respectively, need not be attached to bag-type container 100 equidistant from the top edge 112 of wall panels 102 and 104. Rather, closure mechanisms 114 and 120 may be disposed on wall panels 102, 104 in an offset manner, such that first closure mechanism 114 is relatively closer to the top edge 112 of bag-type container 100 than second closure mechanism 120, or vice versa, as long as the first and second complementary interlockable components of each of the respective closure mechanisms are substantially aligned with one another.

When bag-type container 100 is turned inside out, so that the interior faces of wall panels 102 and 104 are now outside the bag facing away from one another and exterior faces of the wall panels are now inside the bag facing toward one another, the access opening or mouth 113 provided at the top edge 112 of the container is adapted to be sealed by second closure mechanism 120. In this regard, first and second complementary interlockable components 122 and 124 are particularly well-adapted for mutually facilitating alignment and interlocking closure engagement with one another by closing pressure applied from outside of bag wall panels 102 and 104 toward second closure mechanism 120. Bag-type container 100 is relatively easily opened from the top edge 112 of the container by separating manipulation of complementary interlockable components 122 and 124 of second closure mechanism 120.

Bag-type container 100 is preferably fabricated from a suitable plastic film or sheet material, as is common in this art, although the invention is not limited to the type of material employed. For example, wall panels 102 and 104 of bag-type container 100 may comprise a material adapted for eliminating electrostatic charge that can otherwise develop within the container (e.g., during an electrostatic discharge (ESD) event). In this manner, bag-type container 100 can be adapted for packaging electrostatically sensitive items and materials, such as, for example, electronic circuit boards, integrated circuits, etc. Materials which may be well-suited for eliminating electrostatic charge in the bag-type container 100 may include, but are not limited to, conductive films, plastics and laminates, materials impregnated with electrically conductive particles and/or fibers (e.g., metal particles), etc., as will be known by those skilled in the art. For example, U.S. Pat. No. 5,180,615 to Havens, which is incorporated by reference herein, describes various materials which may be used to form an antistatic bag-type container. The ESD protective material of bag-type container 100 preferably also provides protection to the electrostatically sensitive contents when the container is turned inside out.

Figure 3:
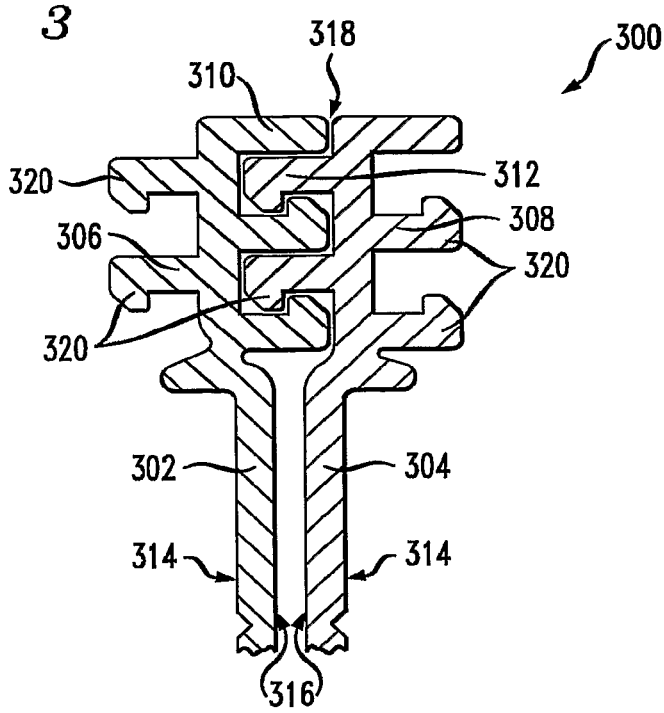
FIG. 3 is a cross-sectional view of an exemplary reversible fastener for use with a resealable bag-type container, formed in accordance with an embodiment of the present invention.

FIG. 3 is a cross-sectional view illustrating an exemplary reversible fastener 300, formed in accordance with another embodiment of the present invention. Fastener 300 may be provided along at least a portion of a top edge 318 of a resealable bag-type container including first and second wall panels, 302 and 304, respectively, as shown. Fastener 300 includes at least first and second closure mechanisms. The first closure mechanism comprises first and second complementary interlockable components, 310 and 312, respectively, which can be coupled together or interlocked. First complementary interlockable component 310 is disposed on an interior face 316 of first wall panel 302 proximate the top edge 318. Likewise, second complementary interlockable component 312 is disposed on an interior face 316 of second wall panel 304 proximate the top edge 318. First and second complementary interlockable components 310, 312 may be formed integrally with their respective wall panels 302, 304, such as, for example, by extrusion. Alternatively, first and second complementary interlockable components 310, 312 may be affixed to their respective wall panels 302, 304 using any known attachment methodology (e.g., heat fusion, adhesive, etc.).

Likewise, the second closure mechanism comprises first and second complementary interlockable components, 306 and 308, respectively, which can be coupled together or interlocked. First complementary interlockable component 306 is disposed on an exterior face 314 of first wall panel 302 proximate the top edge 318, and second complementary interlockable component 308 is disposed on an exterior face 314 of second wall panel 304 proximate the top edge 318. Like the first closure mechanism, first and second complementary interlockable components 306, 308 may be formed integrally with their respective wall panels 302, 304, such as, for example, by extrusion, or affixed to their respective wall panels using any known attachment methodology (e.g., heat fusion, adhesive, etc.).

Fastener 300 is depicted in the figure as being in a closed (e.g., sealed or interlocked) configuration. Each pair of first and second complementary interlockable components 306, 308 and 310, 312 corresponding to the first and second closure mechanisms, respectively, are exemplified by elongate beading structures 320 adapted so that beading structures on opposite wall panels 302, 304 can be coupled together in order to seal the bag-type container. It is to be understood that the invention is not limited to the number, size and/or shape of the elongate structures 320 forming the complementary interlockable components. Additionally, the first and second closure mechanisms need not be aligned with each other, but rather may be disposed on wall panels 302, 304 in an offset manner relative to one another, as previously stated.

Figure 4A:
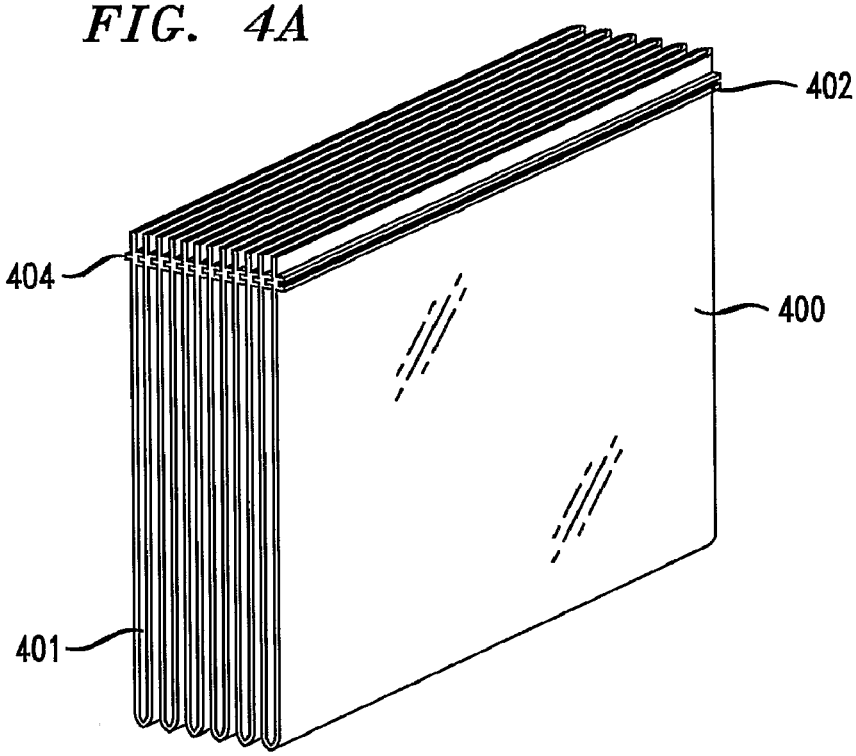
FIG. 4A is a cross-sectional perspective view depicting an exemplary stacking arrangement of multiple bag-type containers including reversible fasteners, in accordance with another aspect of the present invention.

One advantage of the reversible fastener arrangement of an illustrative embodiment of the present invention, whereby complementary interlockable components are disposed on the exterior face of each wall panel of the bag-type container, is that multiple bag-type containers can be stacked together in a convenient, organized manner. For example, FIG. 4A is a cross-sectional perspective view depicting multiple bag-type containers stacked such that a first complementary interlockable component 402 of one bag-type container 400 may be engaged (e.g., coupled or interlocked) with a second interlockable component 404 of a second bag-type container 401. The bag-type containers, having complementary interlockable components disposed on the interior face of each wall panel, can also be stacked to other containers even when turned inside out.

The first complementary interlockable component of a first bag-type container is free to engage with the second complementary interlockable component of a second bag-type container, and the first complementary interlockable component of the second container is free to engage with the second complementary interlockable component of a third bag-type container, and so on until a desired number of bag-type containers are stacked.

Figure 4B:
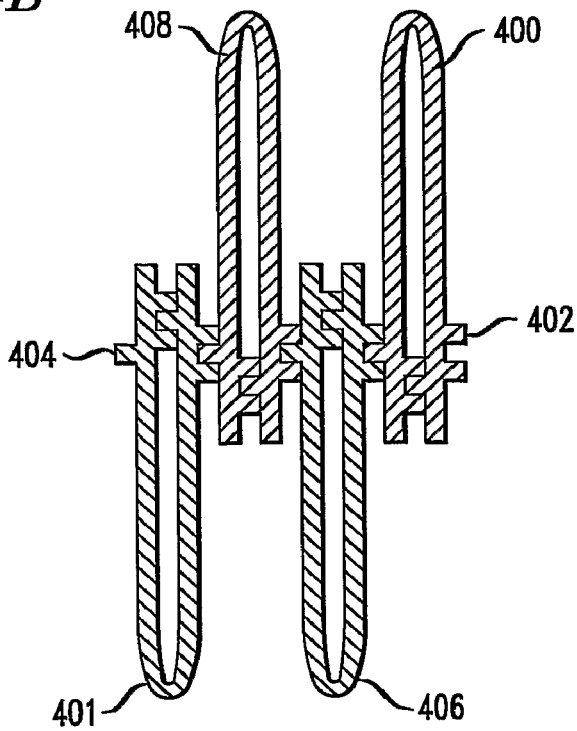
FIG. 4B is a cross-sectional view an alternative exemplary arrangement for stacking multiple bag-type containers, in accordance with an aspect of the invention.

FIG. 4B is a cross-sectional side view depicting an alternative arrangement, compared to the arrangement shown in FIG. 4A, for stacking multiple bag-type containers, in accordance with an aspect of the invention. In this arrangement, rather than stacking all containers in the same direction, adjacent bags are stacked in opposite directions. For example, first bag-type container 400 engages a second bag-type container 406 such that container 400 extends in a direction (e.g., upward) opposite that of container 406 (e.g., downward). Likewise, second bag-type container 406 engages a third bag-type container 408 such that container 408 extends in a direction (e.g., upward) opposite that of container 406. Third bag-type container 408 engages fourth bag-type container 401 such that container 401 extends in a direction (e.g., downward) opposite that of container 408 (e.g., upward). As previously described, two bag-type containers may be interlocked together, for example, by having a first type of complementary interlockable component (e.g., 402) of one container engage with a second type of complementary interlockable component (e.g., 404) of another container, although other attachment means are similarly contemplated.

If the reversible bags are manufactured so that the closure mechanisms disposed on interior faces of the wall panels are offset from the closure mechanisms disposed on exterior faces of the wall panels, a desired stacking arrangement may comprise turning every other bag-type container inside out so as to stack the containers in a staggered manner. This could result in a flatter stacking arrangement.

Figure 5:
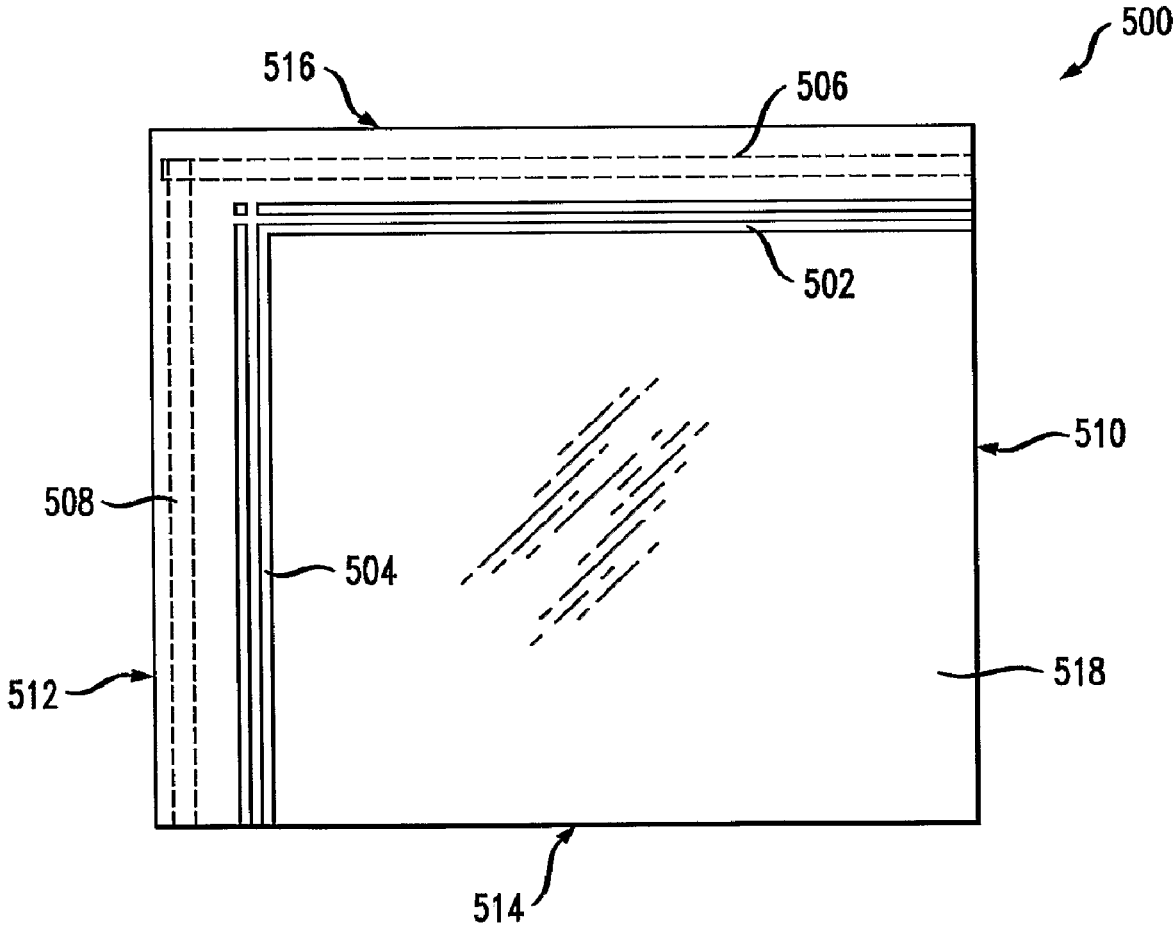
FIG. 5 is a side view depicting an exemplary bag-type container, formed in accordance with an embodiment of the present invention.

FIG. 5 is a side view depicting an exemplary bag-type container 500, formed in accordance with another embodiment of the invention. Bag-type container 500 preferably includes at least one additional pair of closure mechanisms disposed along a periphery of at least a portion of a second edge of the container. The access opening or mouth of bag-type container 500 is thus provided along adjacent edges (e.g., side edge 512 and top edge 516) of the container. Wall panels of bag-type container 500 (of which only one wall panel, 518, is shown for clarity) are joined together or integral along at least a portion of bottom edge 514 and side edge 510. The larger opening beneficially facilitates inserting bulky, unwieldy items into bag-type container 500.

Specifically, bag-type container 500 includes a reversible fastener comprising at least a first closure mechanism 502 disposed along at least a portion of a top edge 516 of the container on an exterior face of each a pair of wall panels forming the container. The reversible fastener further includes a second closure mechanism 504 disposed along at least a portion of a first side edge 512 of bag-type container 500 on the exterior face of each of the wall panels, a third closure mechanism 506 disposed along at least a portion of top edge 516 on an interior face of each of the wall panels, and a fourth closure mechanism 508 disposed along at least a portion of the first side edge 512 of the container on the interior face of each of the wall panels.

Each of the closure mechanisms 502, 504, 506, 508 preferably comprises at least first and second complementary interlockable components adapted for mutually facilitating alignment and interlocking closure engagement with one another in order to seal bag-type container 500, for example in a manner similar to that described above in connection with bag-type container 100 shown in FIG. 1. When used in a standard manner, bag-type container 500 may be sealed by engaging third and fourth closure mechanism 506 and 508, respectively, disposed on interior faces of the wall panels along top edge 516 and side edge 512. Likewise, bag-type container 500 is relatively easily opened from top edge 516 and side edge 512 by separating manipulation of the first and second complementary interlockable components of third and fourth closure mechanisms 506 and 508, respectively. First and second closure mechanisms 502 and 504, respectively, may be used for stacking multiple bag-type containers together, in a manner similar to that described above in connection with FIGS. 4A and 4B. When the bag-type container 500 is turned inside out, first and second closure mechanisms 502 and 504, respectively, are used to control access to the interior of the container, and third and fourth closure mechanisms 506 and 508, respectively, may be used for stacking multiple containers together.

It is to be understood that other configurations of the reversible fastener are contemplated by the present invention. For example, in accordance with other embodiments of the invention, closure mechanisms 504 and 508 may be formed along at least a portion of side edge 510 rather than side edge 512. Alternatively, closure mechanisms may be disposed along both side edges 510 and 512 in order to provide an even larger opening for accessing the interior of bag-type container 500.

Figure 6:
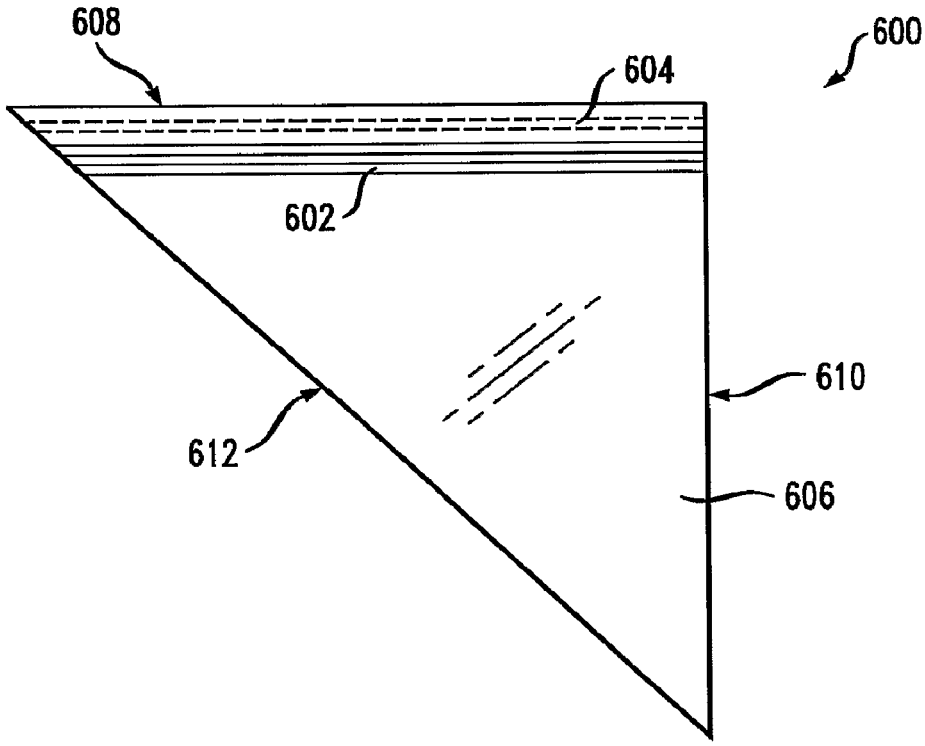
FIG. 6 is a side view illustrating an exemplary bag-type container, formed in accordance with another embodiment of the present invention.

FIG. 6 is a side view illustrating an exemplary bag-type container 600, formed in accordance with another embodiment of the invention. As apparent from the figure, bag-type container 600, in this illustrative embodiment, is triangular in shape, although the invention is not limited to any particular shape and/or size. Bag-type container 600 is preferably formed by two wall panels (of which only one wall panel, 606, is depicted for clarity) joined together or integral along at least a portion of a first edge 610 and a second edge 612. For example, first and second edges 610 and 612, respectively, may be joined together, such as, for example, by heat sealing (or an alternative joining process), or they may be integral, such as, for example, by strategically folding a continuous sheet material.

A top edge 608 of bag-type container 600 is provided with a reversible fastener comprising at least first and second closure mechanisms 602 and 604, respectively. First closure mechanism 602 is disposed on an exterior face of each of the wall panels proximate top edge 608, and second closure mechanism 604 is disposed on an interior face of each of the wall panels proximate the top edge. Top edge 608 provides an access opening or mouth which is adapted to be closed by one of the first and second closure mechanisms 602, 604, depending on whether the container 600 is used in a standard manner or is turned inside out.

Figure 7:
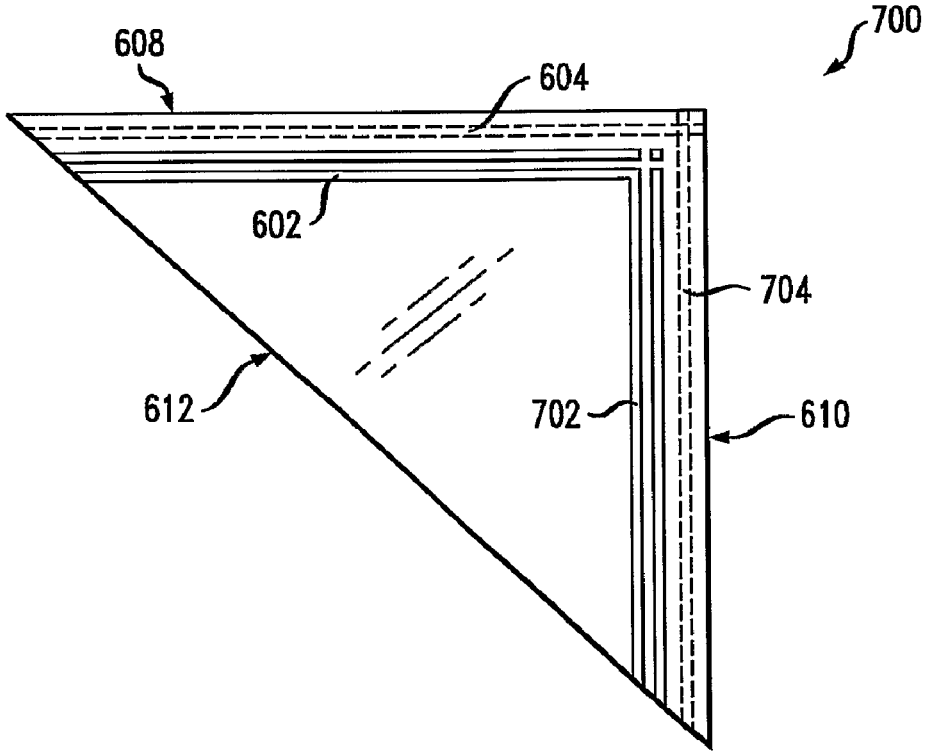
FIG. 7 is a side view illustrating an exemplary bag-type container, formed in accordance with an embodiment of the present invention.

FIG. 7 is a side view illustrating an exemplary bag-type container 700, formed in accordance with an embodiment of the present invention. As apparent from the figure, bag-type container 700 is essentially the same as container 600 shown in FIG. 6, except that the reversible fastener comprises an additional pair of closure mechanisms, 702 and 704, disposed along at least a portion of first edge 610. Specifically, in addition to first and second closure mechanisms 602 and 604, respectively, disposed along top edge 608, bag-type container 700 further includes a third closure mechanism 702 disposed on an exterior face of each of the wall panels along at least a portion of first edge 610, and a fourth closure mechanism 704 disposed on an interior face of each of the wall panels along at least a portion of the first edge.

Each of the closure mechanisms 602, 604, 702 and 704 preferably comprises at least first and second complementary interlockable components adapted for mutually facilitating alignment and interlocking closure engagement with one another in order to seal bag-type container 700, for example in a manner similar to that described above in connection with bag-type container 100 shown in FIG. 1. When used in a standard manner, bag-type container 700 is preferably sealed by engaging second and fourth closure mechanisms 604 and 704, respectively, disposed along top edge 608 and first edge 610. Likewise, bag-type container 700 is relatively easily opened from top edge 608 and first edge 610 by separating manipulation of the first and second complementary interlockable components of second and fourth closure mechanisms 604 and 704, respectively. First and third closure mechanisms 602 and 702, respectively, may be used for stacking multiple bag-type containers together, in a manner similar to that described above in connection with FIGS. 4A and 4B. When bag-type container 700 is turned inside out, first and third closure mechanisms 602 and 702, respectively, are used to control access to the interior of the container, and second and fourth closure mechanisms 604 and 704, respectively, may be used for stacking multiple containers together.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A reversible fastener for a resealable bag-type container having first and second opposing wall panels, each of the first and second opposing wall panels having an interior face and an exterior face, the fastener comprising:

a first closure mechanism including first and second complementary interlockable components disposed on the interior faces of the respective first and second opposing wall panels proximate a top periphery of the first and second opposing wall panels;

a second closure mechanism including first and second complementary interlockable components disposed on the exterior faces of the respective first and second opposing wall panels proximate the top periphery of the first and second opposing wall panels;

a third closure mechanism including first and second complementary interlockable components disposed on the interior faces of the respective first and second opposing wall panels proximate a side periphery of the first and second opposing wall panels; and a fourth closure mechanism including first and second complementary interlockable components disposed on the exterior faces of the respective first and second opposing wall panels proximate the side periphery of the first and second opposing wall panels.

2. The fastener of claim 1, wherein each of the first and second complementary interlockable components are substantially parallel relative to one another along the top periphery of the first and second opposing wall panels.

3. The fastener of claim 1, wherein the bag-type container is adapted to be sealed when the first and second complementary interlockable components of the first closure mechanism on the interior faces of the respective first and second opposing wall panels are engaged with one another.

4. The fastener of claim 1, wherein the bag-type container is adapted to be sealed when the first and second complementary interlockable components of the second closure mechanism on the exterior faces of the respective first and second opposing wall panels are engaged with one another.

5. The fastener of claim 1, wherein one of the first and second complementary interlockable components of the second closure mechanism is adapted for engaging with one of first and second complementary interlockable components of a closure mechanism of at least a second resealable bag-type container to thereby facilitate stacking of the two containers.

6. The fastener of claim 5, wherein the first complementary interlockable component of the second closure mechanism is adapted for engaging with the second complementary interlockable component of the second resealable bag-type container.

7. The fastener of claim 5, wherein the second complementary interlockable component of the second closure mechanism is adapted for engaging with the first complementary interlockable component of the second resealable bag-type container.

8. The fastener of claim 1, wherein each of the first and second complementary interlockable components of at least one of the third and fourth closure mechanisms are substantially parallel relative to one another proximate the side periphery of the first and second opposing wall panels.

9. The fastener of claim 1, wherein at least one of the third and fourth closure mechanisms are arranged substantially perpendicular to the first closure mechanism.

10. The fastener of claim 1, wherein the bag-type container is adapted to be sealed when the first and second complementary interlockable components of each of the first and third closure mechanisms on the interior faces of the respective first and second opposing wall panels are engaged with one another.

11. The fastener of claim 1, wherein the bag-type container is adapted to be sealed when the first and second complementary interlockable components of each of the second and fourth closure mechanisms on the exterior faces of the respective first and second opposing wall panels are engaged with one another.

12. The fastener of claim 1, further comprising at least fifth and sixth closure mechanisms disposed proximate to another side periphery of the first and second opposing wall panels;

wherein the fifth closure mechanism comprises first and second complementary interlockable components disposed on the interior faces of the respective first and second opposing wall panels; and wherein the sixth closure mechanism comprises first and second complementary interlockable components disposed on the exterior faces of the respective first and second opposing wall panels.

13. A resealable, reversible bag-type container, comprising:

first and second opposing wall panels, each of the first and second opposing wall panels having an interior face and an exterior face; and at least one reversible fastener comprising:

a first closure mechanism including first and second complementary interlockable components disposed on the interior faces of the respective first and second opposing wall panels proximate a top periphery of the first and second opposing wall panels;

a second closure mechanism including first and second complementary interlockable components disposed on the exterior faces of the respective first and second opposing wall panels proximate the top periphery of the first and second opposing wall panels;

a third closure mechanism including first and second complementary interlockable components disposed on the interior faces of the respective first and second opposing wall panels proximate a side periphery of the first and second opposing wall panels, and a fourth closure mechanism including first and second complementary interlockable components disposed on the exterior faces of the respective first and second opposing wall panels proximate the side periphery of the first and second opposing wall panels.

14. The bag-type container of claim 13, wherein the first and second wall panels are joined together along at least a portion of at least one peripheral edge by heat sealing.

15. The bag-type container of claim 13, wherein the first and second wall panels are integral along at least a portion of at least one peripheral edge by folding a continuous sheet of material substantially along a center line.

16. The bag-type container of claim 13, wherein each of the first and second complementary interlockable components are substantially parallel to one another.

17. The bag-type container of claim 13, wherein the container is adapted to be sealed when the first and second complementary interlockable components of the first closure mechanism on the interior face of each of the first and second opposing wall panels are engaged.

18. The bag-type container of claim 13, wherein the container is adapted to be sealed when the first and second complementary interlockable components of the second closure mechanism on the exterior face of each of the first and second opposing wall panels are engaged.

19. The bag-type container of claim 13, wherein one of the first and second complementary interlockable components of the second closure mechanism is adapted for engaging with one of first and second complementary interlockable components of a closure mechanism of at least a second resealable bag-type container to thereby facilitate stacking of the two containers.

20. The bag-type container of claim 13, wherein each of the first and second complementary interlockable components of at least one of the third and fourth closure mechanisms are substantially parallel to one another along the periphery of the first and second opposing wall panels.

21. The bag-type container of claim 13, wherein the container is adapted to be sealed when the first and second complementary interlockable components of each of the first and third closure mechanisms on the interior faces of the respective first and second opposing wall panels are engaged with one another.

22. The bag-type container of claim 13, wherein the container is adapted to be sealed when the first and second complementary interlockable components of each of the second and fourth closure mechanisms on the exterior faces of the respective first and second opposing wall panels are engaged with one another.

23. The bag-type container of claim 13, wherein the first and second wall panels comprise an anti-static material.

24. The bag-type container of claim 13, wherein the at least one reversible fastener further comprises at least fifth and sixth closure mechanisms disposed proximate to another side periphery of the first and second opposing wall panels, wherein the fifth closure mechanism comprises first and second complementary interlockable components disposed on the interior faces of the respective first and second opposing wall panels; and wherein the sixth closure mechanism comprises first and second complementary interlockable components is disposed on the exterior faces of the respective first and second opposing wall panels.

25. A method of forming a reversible fastener for a resealable bag-type container having first and second opposing wall panels, each of the first and second opposing wall panels having an interior face and an exterior face, the method comprising the steps of:

forming a first closure mechanism including first and second complementary interlockable components on the interior faces of the respective first and second opposing wall panels proximate a top periphery of the first and second opposing wall panels;

forming a second closure mechanism including first and second complementary interlockable components on the exterior faces of the respective first and second opposing wall panels proximate the top periphery of the first and second opposing wall panels; and forming a third closure mechanism including first and second complementary interlockable components on the interior faces of the respective first and second opposing wall panels proximate a side periphery of the first and second opposing wall panels; and forming a fourth closure mechanism including first and second complementary interlockable components on the exterior faces of the respective first and second opposing wall panels proximate the side periphery of the first and second opposing wall panels.

26. A method of forming a resealable, reversible bag-type container including first and second opposing wall panels, the method comprising the steps of:

joining together at least a portion of the first and second opposing wall panels along a periphery of the first and second wall panels; and forming at least one reversible fastener comprising a first closure mechanism including first and second complementary interlockable components disposed on interior faces of the respective first and second opposing wall panels proximate a top periphery of the first and second opposing wall panels, a second closure mechanism including first and second complementary interlockable components disposed on exterior faces of the respective first and second opposing wall panels proximate the top periphery of the first and second opposing wall panels, a third closure mechanism including first and second complementary interlockable components disposed on the interior faces of the respective first and second opposing wall panels proximate a side periphery of the first and second opposing wall panels, and a fourth closure mechanism including first and second complementary interlockable components on the exterior faces of the respective first and second opposing wall panels proximate the side periphery of the first and second opposing wall panels.

* * * * *